US006817678B2

(12) United States Patent
Seear et al.

(10) Patent No.: US 6,817,678 B2
(45) Date of Patent: Nov. 16, 2004

(54) AUGER MINING SYSTEM

(75) Inventors: Peter Kenneth Seear, Brookfield (AU); Brett Leismann, Pinjarra Hills (AU)

(73) Assignee: Cutting Edge Technology Pty. Ltd., Kenmore (AT)

( * ) Notice: Subject to any disclaimer, the term of this patent is extended or adjusted under 35 U.S.C. 154(b) by 127 days.

(21) Appl. No.: 10/052,493

(22) Filed: Jan. 18, 2002

(65) Prior Publication Data

US 2002/0096934 A1 Jul. 25, 2002

(30) Foreign Application Priority Data

Jan. 23, 2001 (AU) ..... PR2668

(51) Int. Cl.[7] ..... E21C 35/20; E21C 41/18
(52) U.S. Cl. ..... 299/64; 299/19
(58) Field of Search ..... 299/18, 19, 64, 299/55, 56, 42

(56) References Cited

U.S. PATENT DOCUMENTS 3,114,425 A * 12/1963 Adams ..... 180/8.5
3,281,187 A * 10/1966 Adams, et al. ..... 299/55
3,395,940 A * 8/1968 Young, et al. ..... 299/56
3,760,915 A * 9/1973 Young et al. ..... 192/48.3
3,897,976 A * 8/1975 Gallis ..... 299/56
4,309,059 A * 1/1982 Walsh ..... 299/11
5,634,545 A * 6/1997 Plumley ..... 198/303
5,695,016 A * 12/1997 Deeter et al. ..... 175/85

FOREIGN PATENT DOCUMENTS

GB 2229747 A * 10/1990 ..... E21C/41/00

OTHER PUBLICATIONS

Derwent abstract of RU 2024744 C1, Derwent Information Limited, 1995.*

* cited by examiner

*Primary Examiner*—John Kreck
(74) *Attorney, Agent, or Firm*—Ladas & Parry

(57) ABSTRACT

A mining apparatus 10 to mine coal from a seam 11. The apparatus 10 includes a continuous miner 12 to form a mine road 13. Extending along the road 13 is a conveyor 15 having a forward end 20 to which the mined material from the continuous miner 12 is delivered. The apparatus 10 further includes an auger mining machine that advances an auger drill string 28 into the coal seam 11 in a direction generally normal to the road 13, with the mined material also being delivered to the conveyor 15.

4 Claims, 3 Drawing Sheets

AUGER MINING SYSTEM

TECHNICAL FIELD

The present invention relates to mining methods and machines therefore, and more particularly to mining methods and machines that employ augers to mine coal.

BACKGROUND OF THE INVENTION

Longwall mining is one of three underground coal methods typically used. Longwall mining generally includes forming two generally parallel coextensive roads and then removing the coal from between the roads by means of a plough shear or rotatable cutting drum. These items move across the coal face extending between the two roads.

A disadvantage of the above discussed method is that there is required to be provided a shearing apparatus or rotatable cutting drum and associated conveying apparatus to mine and transport the coal to conveyors located in one or more of the roads.

A further disadvantage of Longwall mining is that discontinuities in the seam, such as a fault, can terminate production at that location. The cost of road construction and other infrastructure is therefore lost.

A still further disadvantage is collapse of the mine which may cause subsidence in the adjacent above ground surface.

The second method of mining includes forming a tunnel by blasting and then removing the loose material. This method is relatively dangerous and is frequently used.

The third form of mining includes forming a grid of road or tunnels by means continuous miners. This method has the disadvantage of being reasonably expensive in respect of equipment, while a further disadvantage relates to discontinuities, such as faults, since these will frequently cause termination of production at the particular location.

OBJECT OF THE INVENTION

It is the object of the present invention to overcome or substantially ameliorate the above disadvantages.

SUMMARY OF THE INVENTION

There is disclosed herein a mining apparatus including:

a conveyor to extend along a mine road to convey mined material there along from a forward end to a rearward end of the conveyor;

an auger mining machine positioned adjacent the conveyor to mine material by forming tunnels extending generally normal to the conveyor and to deliver the mined material to said conveyor at a position spaced from said forward end towards said rearward end, and wherein;

said conveyor is adapted to receive at said forward end material mined in forming said road.

Preferably, in the above mining apparatus said conveyor includes:

a pan upon which the mined material rests to be conveyed towards said rearward and by a chain assembly; and said auger mining machine includes:

an auger base proving a cradle to support a plurality of auger string segments;

a motor and drive assembly mounted on said auger base to engage and drive an auger string to form the tunnels, the string being formed from a plurality of said string segments;

a boom assembly to transport said segments and being mounted on the auger base;

said boom assembly including a boom member movable in a direction generally parallel to said conveyor between an extended position and a retracted position to transport said segments between said cradle and said assembly so that the auger strings can be assembled and disassembled.

Preferably, in the above mining apparatus said pan passes beneath said auger mining machine so that mined material provided by the auger mining machine falls to said pan.

Preferably, in the above mining apparatus said auger base includes:

a first base and a second base portion, with said cradle being provided by said second base portion; and said motor and drive assembly is a first drill head, which first drill head is mounted on said first base portion;

said auger mining machine includes a second motor and drive assembly being a second drill head, which second drill head being mounted on said second base portion; and wherein said boom assembly transports the segments between said cradle and drill heads so that tunnels may be formed simultaneously or singularly, with the material mined thereby falling to said pan.

There is further disclosed herein a method of mining including the steps of:

forming a road in a coal seam by advancing a first mining machine into the coal seam to mine material therefrom;

delivering the mined material to a forward end of the conveyor which extends along said road;

conveying the material via said conveyor along said road to a rearward end of the conveyor;

advancing an auger mining machine into the seam from said road in a direction generally normal to said road so as to provide further mined material; and delivering the further mined material to said conveyor to be moved to said rearward end thereby.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
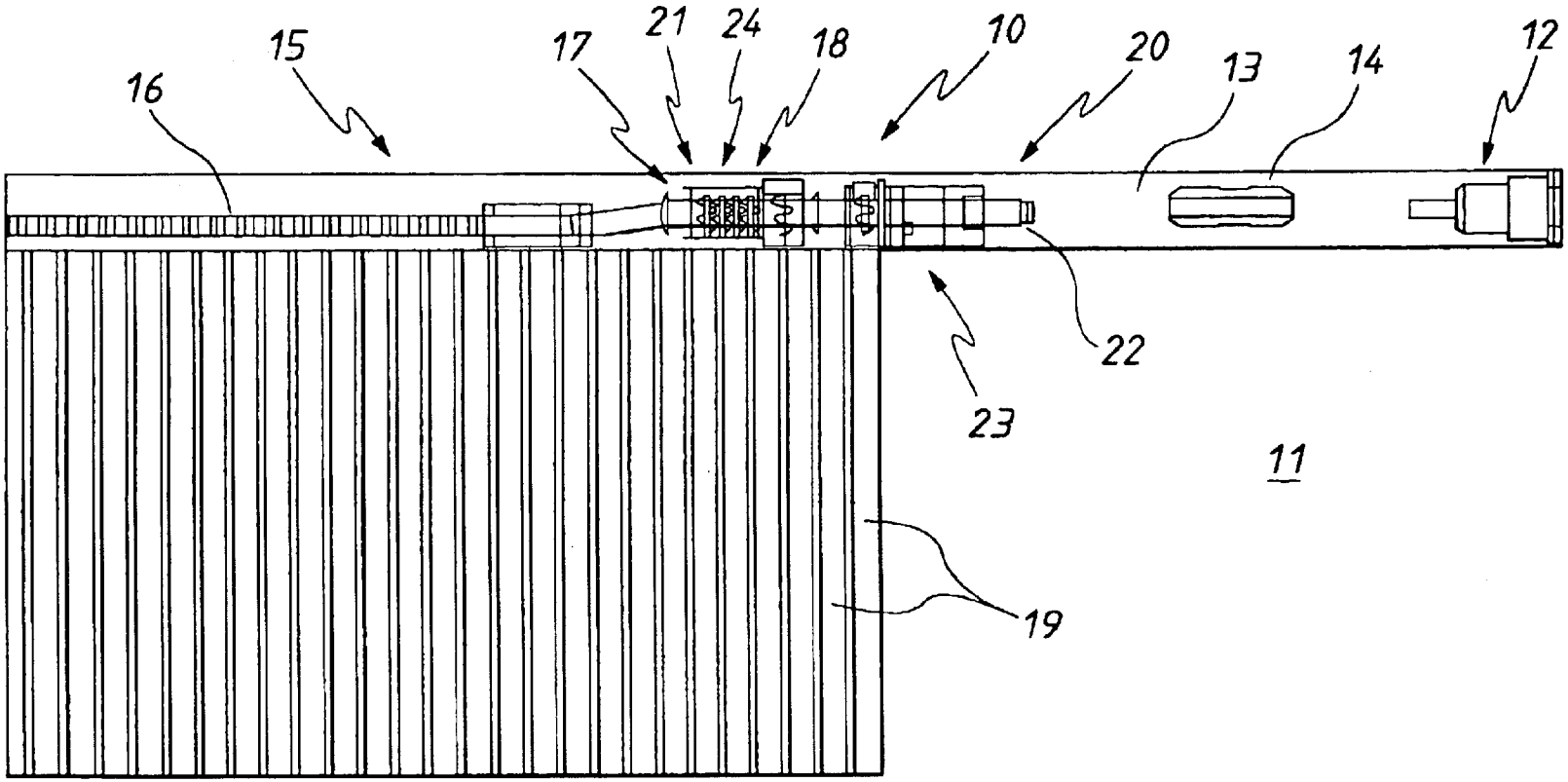
FIG. 1 is a schematic plan view of a mining apparatus mining coal.

In the accompanying drawings, there is schematically depicted a mining apparatus 10. The apparatus 10 is mining coal from a seam 11. In this embodiment, the apparatus 10 is using a mining machine (continuous miner) 12 that is mining coal to form the mine road 13. The mined coal provided by the machine 12 is moved to tho apparatus 10 by means of a shuttle car 14.

The apparatus 10 includes a conveyor 15 having a first chain conveyor 16 that convoys the mined material to a position at which the coal can be removed from the mine.

Communicating with the chain conveyor 16 is a belt conveyor 17 that is associated with an auger mining machine 18. The conveyors 16 and 17 extend generally in the direction of extension of the road 13. The conveyor 17 has a forward end 20 and a rearward end 21, with the forward end 20 being provided a hopper 22 which receives coal from the shuttle car 14. The coal is conveyed by the conveyor 17 to the conveyor 16.

Associated with the conveyor 17 is an auger mining machine 18 which mines coal by forming generally horizontally extending tunnels 19. The mined coal provided by the auger mining machine 18 is delivered to the conveyor 17. In this respect, it should be appreciated that the conveyor 17 passes beneath the auger mining machine 18 so that the coal mined thereby falls onto the conveyor 17. Preferably, the conveyor 17 is a chain conveyor including a pan, upon which the coal fall, and a chain assembly that transports the coal.

Figure 2:
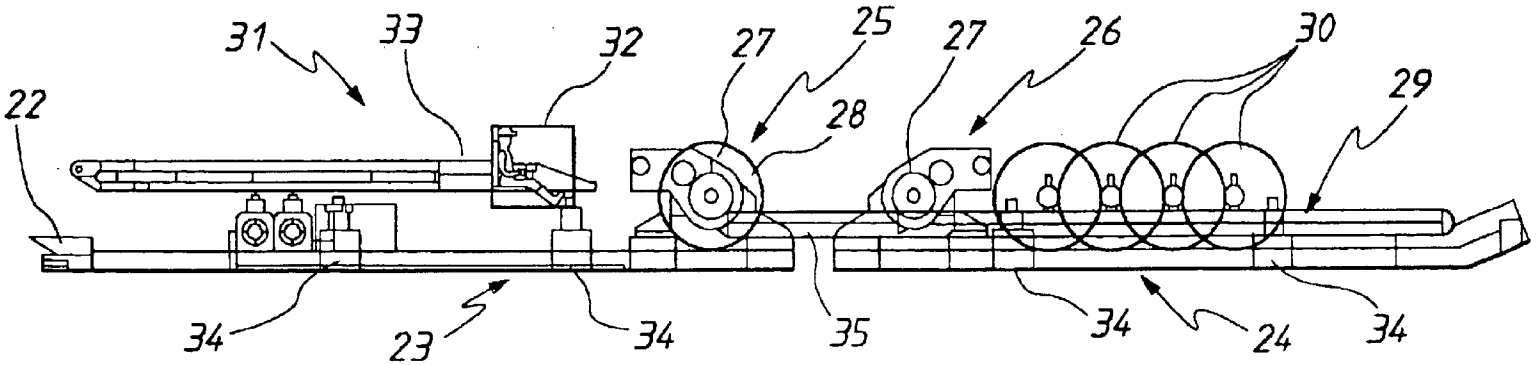
FIG. 2 is a schematic side elevation of an auger mining machine employed in the apparatus of FIG. 1.
Figure 3:
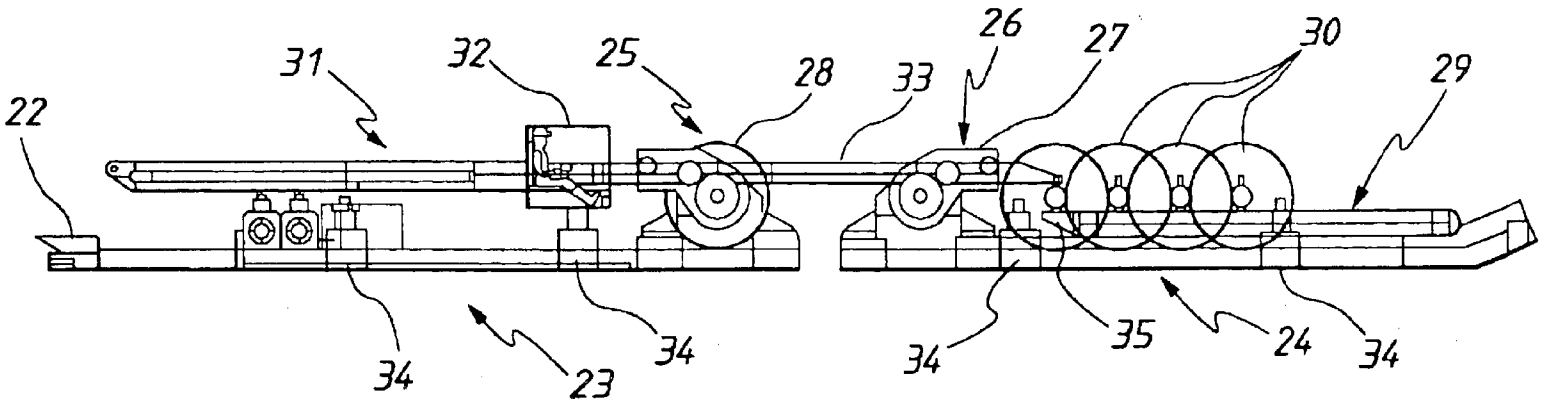
FIG. 3 is a further schematic side elevation of the auger mining machine of FIG. 2.

The auger mining machine 18 includes a base comprising two base portions 23 and 24, with the base portion 23 having a drill head 25 and the base portion 24 having a drill head 26. Each drill heads 25 and 26 includes a motor and drive assembly 27 which cause rotational and longitudinal movement of associated auger drill strings 28. In FIGS. 2 and 3, only one drill string 28 is illustrated.

In this embodiment, the base portion 24 provides a cradle 29 that can store a plurality of drill string segments 30 for use by both drill heads 25 and 26. The cradle 29 has an extendable track 35 for the transfer of the segments 30 between the base portions 23 and 24. To move the segments 30 to and from alignment with the drill heads 25 and 26 there is provided a boom assembly 31 which is controlled by an operator positioned in a cabin 32. The boom assembly 31 has extendible boom member 33 which engages the segments 30 to move them to and from alignment with the drill heads 25 and 26. When tunnels 19 are being formed operation of the boom assembly 31 transfers segments 30 to the drill heads 25 and 26. Upon completion of a tunnel 19 the drill strings 28 are dismantled and the segments 30 returned to the cradle 29 by means of the boom assembly 31.

The base portions 23 and 24 include jacks 34 which are operable to raise the portions 23 ad 24 to enable the conveyor 17 to pass beneath the portions 23 and 24.

In respect of the above preferred embodiment it should be appreciated that the apparatus 10 could be configured to form tunnels 19 on either side of the road 13.

It should be appreciated that the apparatus 10 could be used to form the tunnels 19 sequentially. That is as one tunnel 19 is being formed the segments 30 could be removed from the previously formed tunnel and added to the auger string 28 forming the next adjacent tunnel 19. In this respect, it should still further be noted that the base portions 23 can be spaced by one or more tunnels 19.

Figure 4:
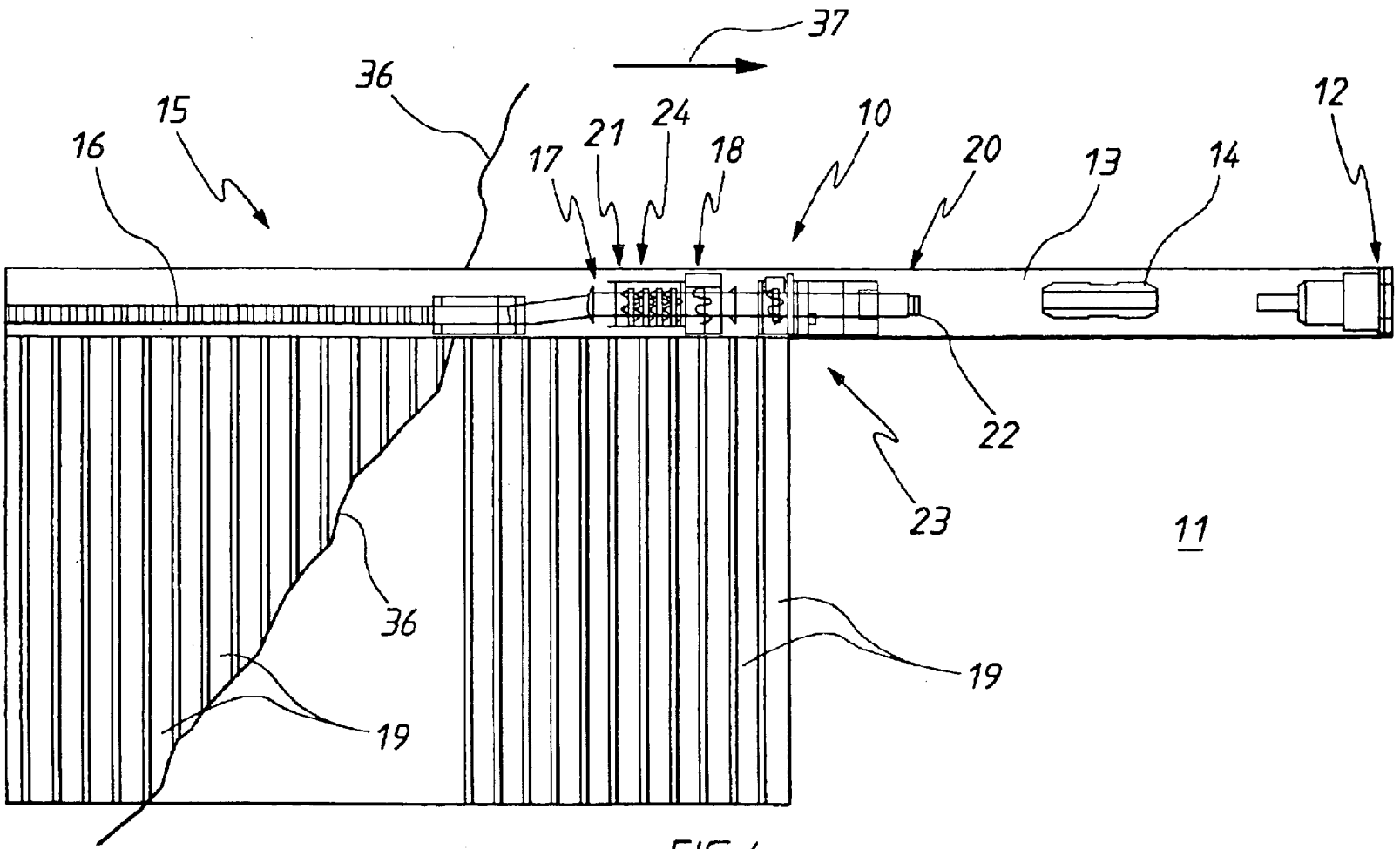
FIG. 4 is a further plan view of the apparatus of FIG. 1.

FIG. 4 is a schematic illustration of the apparatus 10 mining coal from a seam in which there is a fault or discontinuity 36. As the apparatus 10 moves in the direction of the arrow 37 along the road 13 tunnels 19 are formed until they reach the discontinuity 36. At that stage, the tunnel 19 is terminated and the next tunnel 19 commenced. Once the discontinuity 36 has been passed tunnels 19 of full length can then be formed.

The claims defining the invention are as follows:

1. A mining apparatus including:

a conveyor to extend along a mine road to convey mined material there along from a forward end to a rearward end of the conveyor;

an auger mining machine positioned adjacent the conveyor to mine material by forming tunnels extending generally normal to the conveyor and to deliver the mined material to said conveyor at a position spaced from said forward end towards said rear end and;

a hopper at said forward end to receive material mined in forming said road.

2. The mining apparatus of claim 1 wherein said conveyor includes:

a pan upon which the mined material rests to be conveyed towards said rearward end by a chain assembly; and said auger mining machine includes:

an auger base providing a cradle to support a plurality of auger string segments;

a motor and drive assembly mounted on said auger base to engage and drive an auger string to form the tunnels, the string being formed from a plurality of said string segments;

a boom assembly to transport said segments and being mounted on the auger base;

said boom assembly including a boom member movable in a direction generally parallel to said conveyor between an extended position and a retracted position to transport said segments between said cradle and said assembly so that the auger strings can be assembled and disassembled.

3. The mining apparatus of claim 2 wherein said pan passes beneath said auger mining machine so that mined material provided by the auger mining machine falls to said pan.

4. The mining apparatus of claim 2 said auger base includes:

a first base and a second base portion, with said cradle being provided by said second base portion; and said motor and drive assembly is a first drill head, which first drill head is mounted on said first base portion;

said auger mining machine includes a second motor and drive assembly being a second drill head, which second drill head being mounted on said second base portion; and wherein said boom assembly transports the segments between said cradle and drill heads so that tunnels may be formed simultaneously or singularly, with the material mined thereby falling tos aid pan.

* * * * *